US005217115A

United States Patent [19]

Purkapile

[11] Patent Number: 5,217,115

[45] Date of Patent: Jun. 8, 1993

[54] REUSABLE TOOL PACKAGING MEMBER AND SYSTEM

[75] Inventor: Emerson Purkapile, Chicago, Ill.

[73] Assignee: Cetco International, Norcross, Ga.

[21] Appl. No.: 800,919

[22] Filed: Dec. 3, 1991

[51] Int. Cl.[5] ..... B65D 85/00; B65D 85/20; B65D 25/10

[52] U.S. Cl. ..... 206/373; 206/378

[58] Field of Search ..... 206/372-379

[56] References Cited

U.S. PATENT DOCUMENTS

| | | | |
|---|---|---|---|
| 4,118,085 | 10/1978 | Fibus | 312/245 |
| 4,492,153 | 1/1985 | Grabowski | 206/508 |
| 4,561,705 | 12/1985 | Schafer | 312/244 |
| 4,653,637 | 3/1987 | Wallace | 206/372 |
| 4,819,800 | 4/1989 | Wilson | 206/373 |
| 4,987,998 | 1/1991 | Tsai | 206/372 |
| 4,998,616 | 3/1991 | Hillinger | 206/372 |
| 5,083,664 | 1/1992 | Feng | 206/378 |

*Primary Examiner*—William I. Price

*Attorney, Agent, or Firm*—Willian Brinks Olds Hofer Gilson & Lione

[57] ABSTRACT

A tool packaging system of complementary plastic planar members snapfit together and interlocked therebetween to allow a planar assembly or a configuration akin to a toolbox. In an alternative embodiment, complementary extruded plastic planar members may be slidably engaged and snapfit to provide either a planar assembly, or rectangular prism assembly which is completed by snap-fitting end caps thereto.

30 Claims, 5 Drawing Sheets

REUSABLE TOOL PACKAGING MEMBER AND SYSTEM

FIELD OF THE INVENTION

This invention relates generally to reusable tool packaging members for organizing, displaying, and storing hand tools, and more particularly to tool packaging systems with plastic members with interlocking means situated at the perimeter thereof to engage complementary plastic members for such purposes.

BACKGROUND OF THE INVENTION

Socket wrenches, socket drivers, sockets, socket extenders and other hand tools are usually offered to consumers in pre-packaged sets, consisting, for example, of various socket and/or socket driver sizes. Hand tools are traditionally packaged in three ways. First, the tools may be loose for bulk display and sales. Second, the tools may be enclosed in nonreusable display packaging. Third, the tools may be placed in boxes that serve as both shipping containers and reusable storage devices designed for future use by the consumer for tool storage purposes.

Such present tool packaging and displaying practices have significant disadvantages, however. Loose bulk displays are not favored by retailers given their inherent propensity for promoting shoplifting and preventing inventory control of loose tools. Moreover, these inefficiencies affect the consumer by causing increased hand tool prices. Non-reusable display packaging of plastic films, such as overwraps, heat shrink packing, and blister packs may ameliorate the disadvantages of loose or bulk displays, but create significant environmental burdens following first use of the enclosed tools because such materials are not recyclable nor biodegradable. Packaging in rigid containers, which are intended for reuse by the consumer, have also traditionally not been in the most desirable form, and often entail excessive difficulty and expense from the standpoint of manufacture, product loading, and assembly. For instance, reusable metal packaging provides many difficulties including a propensity to rust, thereby creating added expense in painting all exposed metal, the possibility of tool damage from metal enclosures, the additional shipping expense due to weight increase from the metal package, the added expense of welding or package component assembly, and general inflexibility in merchandising. With the advent of plastic, and blow molded configurations in general, many of the inherent disadvantages of metal were replaced by disadvantages of blow molded plastic and associated process, namely packaging dimensional inefficiencies such as thicker wall sections required by the blow molding process, lack of package durability, and other inherent general design limitations in molding tools due to blow molded plastic properties.

Nevertheless, consumers continue to need a means for storage of their tools in a neat and well organized manner. Many forms of reusable storage products for tools have been disclosed in the prior art, typical of which are those described in the foregoing United States Patents. U.S. Pat. No. 4,819,800 to Wilson describes a toolbox formed of identical shallow halves hinged together so that they can be folded and locked and carried by integral handles. A set of supports permit the box to be temporarily attached to a vertical wall.

A wall mounted tool cabinet is taught in Fibus U.S. Pat. No. 4,118,085, which consists of three units hinged to one another, each unit formed of four plastic frame sections and a peg board material backing thereto to position tools therein with standard wire hooks.

An integrally formed, plastic member capable of being erected into a tool rack is shown in Wallace U.S. Pat. No. 4,653,637; it is packaged along with a set of screw drivers for which the rack is intended to be used.

U.S. Pat. No. 4,987,998 to Tsai describes a metal frame plate with removable metal C-shaped clips for collecting and storing sockets and socket wrenches, which are mounted on the metal frame.

Despite the foregoing, a need still exists for an effective and yet relatively inexpensive reusable tool package system which securely holds a component hand tool in place during shipping, storage, and display, that may be interlocked with mating storage and display components to provide a permanent storage case for various tool sets, as well as a project support device where the tool case may be unfolded thereby creating a wall display and storage unit.

Accordingly, it is a broad object of the present invention to provide a novel packaging system comprising reusable components thereby eliminating tool packaging debris.

It is also an object of the invention to provide a novel article to store and organize a tool set which may be mounted on vertical surfaces, erected to stand freely on horizontal surfaces, and folded into a readily portable unit.

Another object of the invention is to provide a durable, shatter resistant reusable package which is economical and manufacturable.

It is a final object to provide a novel package with the foregoing features and advantages, together with a plurality of tools to be supported, organized, and displayed thereby.

SUMMARY OF THE INVENTION

It has now been found that certain of the foregoing and related objects of the invention are readily attained by the provision of a planar member provided with a plurality of coplanar fingers placed about the perimeter of the planar member. The planar member has means for securing various tools, including for example, sockets, socket drivers, socket wrenches, and socket extenders. The planar member fingers are provided with either integral protrusions or indentations to snap fit with other mating planar members of complementary geometries thereby providing an interlocking system of reusable tool storage components.

In one embodiment thereof, each of the planar members have a rectangular perimeter, with regularly spaced square coplanar fingers that provide a configuration symmetrical about major and minor axes. In one species of planar member, square coplanar fingers extend from the vertices of the member to define notches in the sides of the member. The fingers of this species planar member are each provided with pairs of protrusions positioned in the interior notch surfaces and located such that the protrusions on adjacent fingers are collinear and parallel to the coplanar member. This member may be provided with means for retaining and organizing tools, such as sockets, comprising for example, V-shaped clips, that engage the interior space within a socket defined for drivers thereof. In the second species of planar member, regularly spaced square coplanar fingers extend latitudinally and longitudinally from the sides of the member to define adjacent notches, which advantageously mesh with notches of the first species planar member. The fingers of this second species member have pairs of indentations matching the protrusions of the first species upon meshing thereof. The matching pairs of protrusions and indentations contact upon meshing of respective fingers to provide an interference fit, and are appropriately located to allow the first and second species members to interlock akin to a hinge thereby allowing the first species member to rotate with respect to the second species member about an axis defined by the collinear interfering protrusions and indentations of respective member fingers. The second species member will also generally have means for affixing and organizing tools, such as a socket wrench, comprising for example, L-shaped clips extending normal to the planar member and appropriately engaging the socket wrench.

Alternatively, in another embodiment, a generally planar member has a pair of coplanar fingers extending from opposite sides thereof. One finger is defined into a longitudinal continuous integral hinge and at the free end thereof a continuous tongue integral therewith. The other finger is defined into a longitudinal continuous integral groove configured to slidably engage and snap fit about the tongue. Between the integral hinge and groove is a panel with tool attachment means, such as opposed longitudinal continuous integral V-shaped members designed to slidably engage sockets with axes longitudinally oriented or socket wrenches longitudinally oriented. A plurality of such members may thereby be slidably connected and folded about respective longitudinal integral hinges to form a right prism of triangular, rectangular, etc. cross-section. A tool case may be formed therefrom by merely snap fitting the free tongue and groove of respective members and placing end caps normal to the assembly at the open ends thereof.

Other objects of the invention are achieved by providing appropriately placed removable sections on the planar members or panels that allow for appropriate merchandising of tools retained by individual planar members or panels. Such sections, when removed, provide for the use of typical wire hanger displays employed by hardware retailers. These removed sections may also be utilized with conventional support means such as screws or nails by the consumer for semipermanent installation on vertical walls or the like.

The foregoing features and advantages of this invention will be further understood upon consideration of the following detailed description of embodiments of the invention taken in conjunction with the accompanying drawings, in which:

DETAILED DESCRIPTION OF EMBODIMENTS OF THE INVENTION

Figure 1:
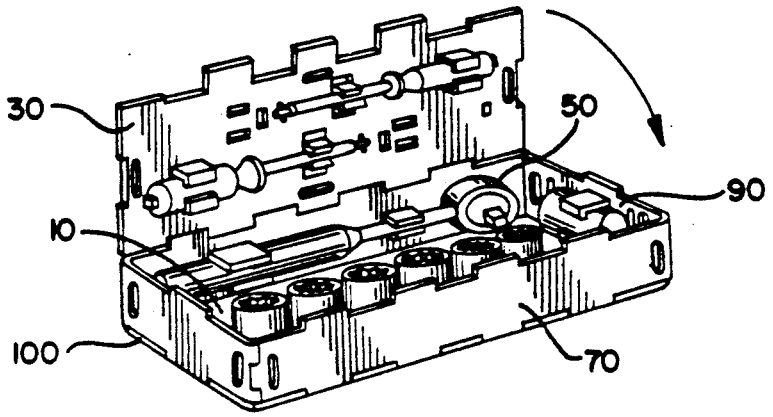
FIG. 1 is a perspective view of an article embodying the present invention, being erected into a right rectangular prism to provide a toolbox for organizing hand tools, such as the socket wrench, socket driver, and accompanying sockets as shown.

As illustrated in detail in FIGS. 1-11 of the drawings, a novel article embodying the present invention is disclosed, which may be folded and erected into a toolbox as depicted in FIG. 1. An alternative article embodying the present invention, as illustrated in detail in FIGS. 12-16, is described following discussion of the first article.

As shown in FIG. 1, the first article embodying the novel invention is comprised of six (6) generally planar members; base member 10, top member 30, first side member 50 and second side member 70, and first end member 90, and second end member 100. When top member 30 is rotated about the axis defined by the union of first side member 50 and top member 30 in the direction depicted by the arrow in FIG. 1, to engage side member 70, a toolbox suitable for transporting hand tools is formed. Perhaps best depicted in FIG. 2, when all members are placed on the same general plane but at least one union is maintained between members previously joined in a box configuration, members 10, 30, 50, 70, 90, 100 are displayed. In this configuration, the novel article may be mounted on a vertical wall, including vertical walls of moving vehicles and the like. Moreover, this configuration may be placed on any horizontal surface, either planar or curved, to allow ready access to the tools snap-fitted thereto.

Figure 3:
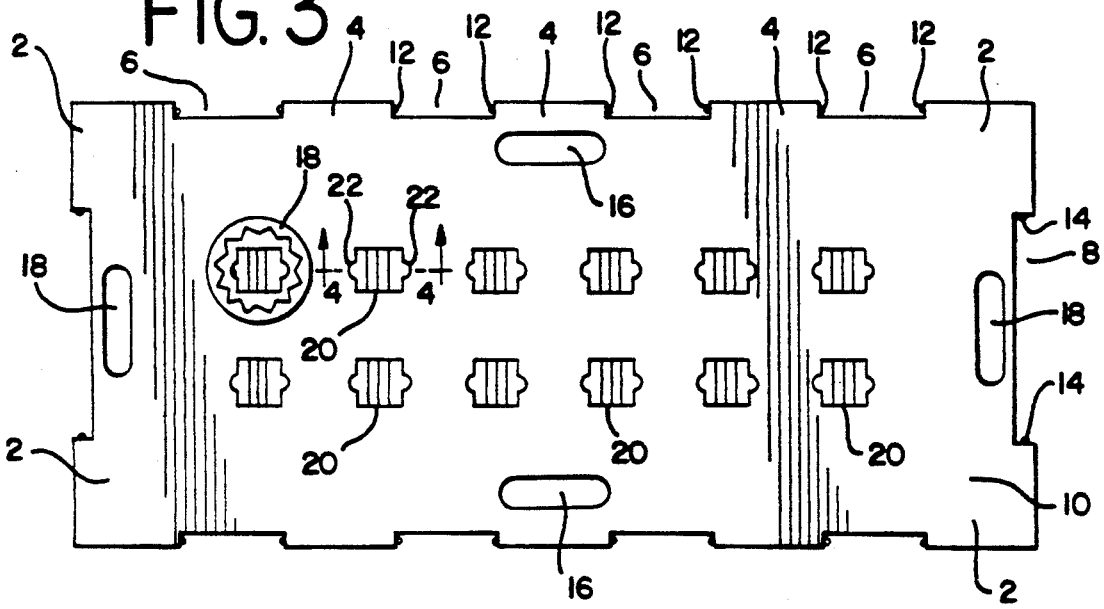
FIG. 3 is a plan view of the base member of the toolbox shown in FIG. 2.

As shown in FIG. 3, planar base member 10 is of general rectangular configuration and symmetrical about the major axis (running longitudinally and bisecting the member) and the minor axis (running latitudinally and bisecting the member). Extending from the vertices of base member 10, and in the same plane defined by the member, are rectangular fingers 2. Latitudinal fingers 4 extend in the same plane as bottom member 10, and outward from the longitudinal sides of base member 10. These fingers 2, 4 define notches 6 along the longitudinal side of base member 10. Additionally, notches 8 are defined by fingers 2 that are along the latitudinal side of base member 10. Notches 6, 8 are all preferably square and normal to base member 10. The latitudinal sides of fingers 2, 4 adjacent notches 6 are provided with collinear protrusions 12 extending into notches 6 and parallel to the plane of base member 10. The longitudinal sides of fingers 2 adjacent notches 8 are also provided with collinear protrusions 14 extending into notches 8 and parallel to the plane of base member 10. Such protrusions 12, 14 are preferably integral pins, hemispherically configured.

Figure 4:
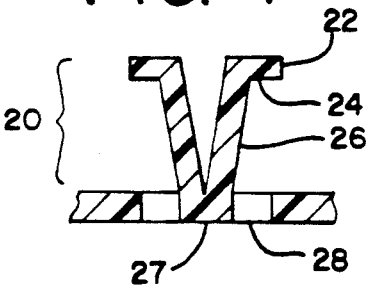
FIG. 4 is a sectional view of the socket retaining means taken along line 4—4 of FIG. 3.

Socket retention V-clips 20, are located on one planar surface of base member 10. Each V-clip 20 is suitably located on base member 10 for retaining various sizes of a socket hand tool 18. V-clip 20 has integral therewith, tabs 22 suitably located to engage the interior indentations of socket hand tool 18 that are normally employed by the ball bearing engagement of typical drivers for socket hand tool 18. V-clip 20, as shown in FIG. 4, is comprised of horizontal members 24 with end tabs 22, descending legs 26 therefrom, and junction member 27 that is preferably integral with base member 10, but may be affixed to base member 10 by a suitable bonding means such as hot glue and the like, and voids 28 to allow for the required spring action of descending legs 26 for the purposes of placing socket hand tool 18 over V-clip 20 and removing socket hand tool 18 from V-clip 20.

Removable section 18, depicted straddling the major axis of base member 10, and removable section 16, straddling the minor axis, are initially integral with base member 10. If required for display purposes, such as presentation to consumers using typical wire rack assemblies found in retail hardware stores, removable sections 16, 18 may be readily knocked out for display purposes. Additionally, removable sections 16, 18 may be used to secure base member 10 to vertical or horizontal surfaces as the end user may see fit with conventional nails or screws extending therethrough. Removable sections are preferably located straddling lines through the center of gravity of a member fully-loaded with tools and parallel to the major and minor axes of the member.

Figure 7:
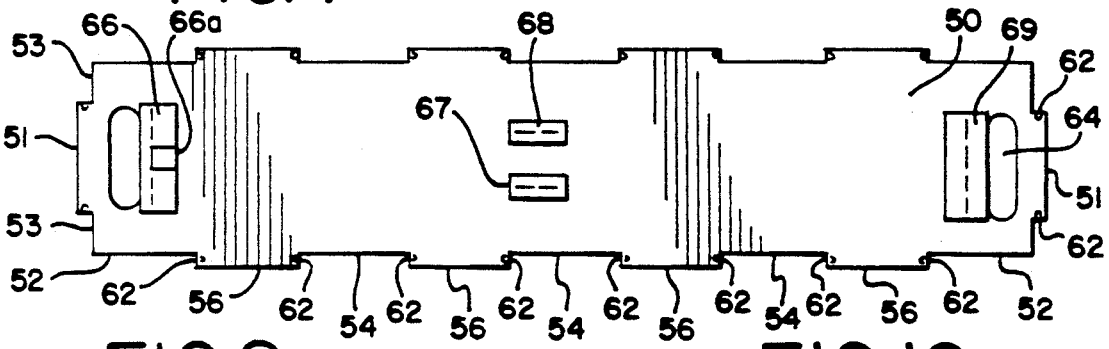
FIG. 7 is a plan view of the first side member of the toolbox.

First side member 50 for retaining a socket wrench, as shown in FIG. 7, is a generally planar rectangular member, and generally symmetrical about major (running latitudinal) and minor (running longitudinally) axes. Coplanar rectangular fingers 51 extend longitudinally from side member 50 along the major axis thereof defining adjacent notches 53. Extending latitudinally from side member 50, and in the same plane thereof, are fingers 56 defining notches 52, 54 which are preferably square and normal to side member 50. Fingers 56 and notches 52, 54 are dimensioned such that they are complementary to, and mesh with fingers 2, 4 and notches 6 (FIG. 3) of base member 10. The latitudinal sides of fingers 56 and longitudinal sides of fingers 51 are provided with collinear indentations 62, parallel to the plane of side member 50. Such indentations are preferably hemispheres, or sockets.

Located on one plane of side member 50 and normal thereto are socket wrench head retention means 66, socket wrench shaft retention means 67, 68, and socket wrench handle retention means 69. Socket wrench head attachment means 66 is a generally inverted L-shaped member, the length thereof normal to side member 50 and free short leg thereof extending toward the minor axis and parallel to the plane of side member 50. The short leg of the L-shaped member 66 is provided with a slot allowing space for the socket wrench driver to be located therein. Additionally, plug 66A formed integral with side member 50, with a plan view defined by the aforementioned slot in L-shaped member 66, is at a height equivalent to allow a socket wrench head to fit within the space defined by L-shaped member 66 and plug 66A and allow the wrench to repose longitudinally in a horizontal position on side member 50. Socket wrench shaft retention means 67, 68 are inverted L-shaped members normal to side member 50 and short legs thereof extending toward one another and straddling the major axis of side member 50 with sufficient height above side member 50 to allow for placement of the socket wrench shaft within the space defined therein. Socket wrench handle retention means 69 is an inverted L-shaped member, the length thereof normal to side member 50 and short leg thereof extending toward the minor axis and parallel to the plane defined by side member 50. The retention means 66, 67, 68, 69 are preferably integral to side member 50, but may be affixed by hot melts, glue or the like. Removable sections 64, straddling the major axis of side member 50, are provided for display and securing purposes.

Figure 5:
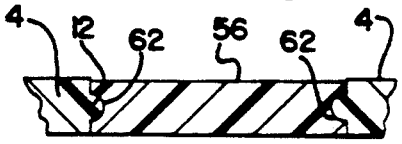
FIG. 5 is a sectional view of meshing complementary fingers with interlocking pins and sockets of the toolbox in partially constructed and flat condition, taken along line 5—5 of FIG. 2.

The complementary geometry of fingers 56, sockets 62 therein, and adjacent notches 52, 54 are such that side member 50 may interlock with fingers 2, 4, notches 6, and pins 12 of base member 10. For example, for the arrangement shown in FIG. 2, fingers 2 mesh with notches 52, fingers 56 mesh with notches 6, and fingers 4 mesh with notches 54. Upon proper finger meshing of side member 50 with base member 10, an interlocking arrangement occurs when fingers 56 fully engage notches 6, such that, as shown in FIG. 5, an interlocking engagement between pins 12 and sockets 62 occur which provide an interference fit therebetween. An interlocking arrangement is thus created whereby side member 50 and base member 10 may not only lie in the same plane, but one member may have a degree of rotation more than 270 degrees with respect to another while being interlocked.

Figure 8:
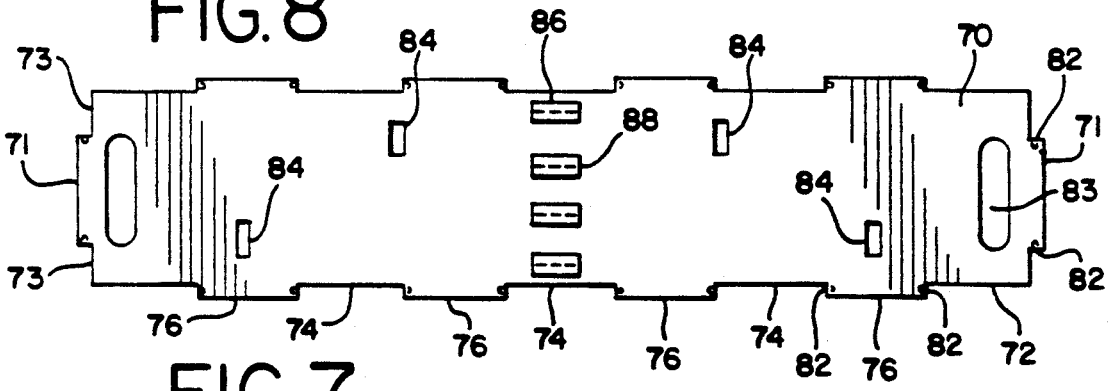
FIG. 8 is a plan view of the second side member of the toolbox.

Additional members employing the same finger geometries and interlocking mechanism may also be provided to retain additional hand tools and also create many useful configurations, including a tool box. As shown in FIG. 8, second side member 70 for socket shaft extensions, with fingers, notches and sockets identically dimensioned to first side member 50 (FIG. 7), has finger 71 configured identically to finger 51, defining notches 73 identical to notches 53, and fingers 76 configured identically to fingers 56, defining notches 72, 74 identical to notches 52, 54 respectively. Sockets 82 located within fingers 71 and 76 are similarly dimensioned and located as sockets 62, thereby allowing for a similar interlocking arrangement between side member 70 and base member 10. Located on one plane of side member 70 are socket extension hand tool retention means 86, 88 which are inverted L-members normal to one plane of side member 70. The free ends of L-shaped members 86, 88 extend toward one another, with distance therebetween such that a socket extension hand tool may be inserted within the cavity defined thereby. Rectangular ribs 84 are positioned symmetrically about the minor axis of side member 70 a distance suitable to retain the length of a typical socket extension hand tool and side dimensioned to prevent longitudinal movement, thereof. Retention means 86, 88 and ribs 84 are preferably integral to side member 70, but may be affixed by hot melts, glue or the like. Side member 70 is also provided with removable sections 83, straddling a line parallel to the major axis that extends through the center of gravity of side member 70 when socket extensions are retained thereto.

Figure 10:
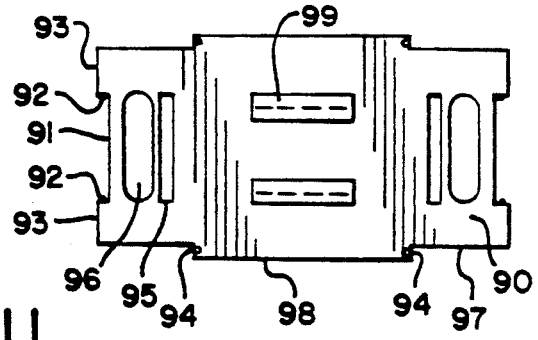
FIG. 10 is a plan view of the first end member of the toolbox.

End member 90 as shown in FIG. 10, is a generally rectangular planar member and symmetrical about its major (running longitudinally) and minor (running latitudinally) axis. Generally rectangular coplanar longitudinally-extending fingers 93, with sides thereof defined by latitudinal sides of end member 90, defines notch 91. Notch 91 is preferably square and normal to end member 90. Fingers 93 are dimensioned such that they are complementary to, and mesh with either fingers 51 of side member 50 or fingers 71 of side member 70. The longitudinal sides of fingers 93 adjacent notches 91 have collinear protrusions 92, extending into notch 91, and parallel to the plane of end member 90. Such protrusions 92 are preferably integral pins, hemispherically configured. Extending latitudinally from end member 90 are generally rectangular coplanar integral fingers 98, defining adjacent notches 97. Notches 97 are preferably square and normal to end member 90. Fingers 98 are dimensioned such that they are complementary to, and mesh with fingers 2 of base member 10. The latitudinal sides of fingers 98 have collinear indentations 94 parallel to the plane of end member 90, and preferably hemispherical indentations, or sockets.

Positioned on one plane of end member 90 are socket hand tool sleeve retention means 99 and positioning ribs 95. Sleeve retention means 99 are a pair of inverted L-shaped members, secured at the free ends and normal to end member 90 and oriented to face the major axis thereof, and are positioned to retain the sleeve of a long socket hand tool with longitudinal axis running parallel to the major axis of end member 90. Ribs 95 are positioned a sufficient distance from the minor axis of end member 90 to prevent longitudinal displacement. Retention means 99 and ribs 95 are preferably integral to end member 90, but may be affixed by hot melts, glue or the like. Removable section 96 may be removed for display purposes, as well as affixing end member 90 to a wall or table.

The configuration of end piece 90 provides the keystone for assembly of base member 10, and side members 50, 70 into a toolbox. The complementary geometry of fingers 93 and notch 91 are such that end member 90 may interlock with notches 53, finger 51 of side member 50, respectively (or notches 73, and finger 71 of side member 70). Upon meshing of respective fingers and notches of the end and side members, an interlocking engagement is created between respective sockets 62 (or 82) and pins 92 which have an interference fit therebetween, thereby allowing the end member 90 to rotate perpendicular to side member 50. Moreover, the complementary geometry of finger 98 and notches 97 are such that end member 90 may interlock with notch 8, and fingers 2 of base member 10, respectively. Upon meshing of respective fingers and notches of the base and end members, an interlocking engagement is created between respective pins 14 and sockets 94 which have an interference fit therebetween, thereby completing an orthogonal relationship between end member 90, side member 50 and base member 10.

Figure 9:
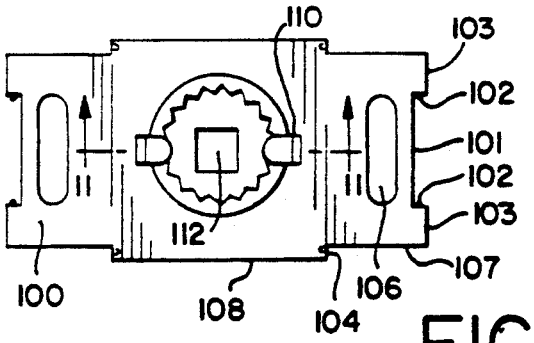
FIG. 9 is a plan view of the second end member of the toolbox.
Figure 11:
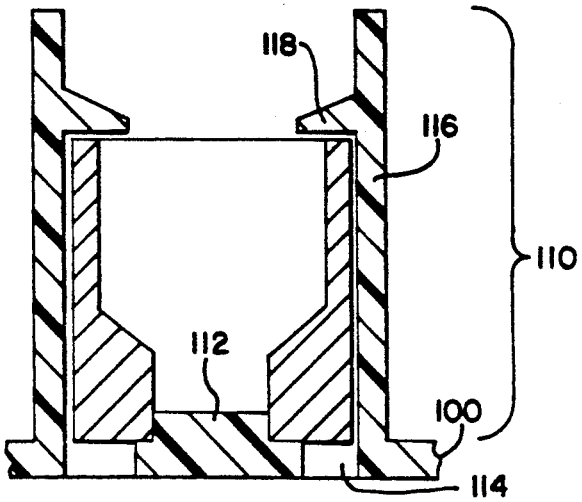
FIG. 11 is a sectional view of the socket retaining means shown in FIG. 9, taken along line 11—11 of FIG. 9.

End member 100, for retaining socket hand tools as shown in FIG. 9, is a generally rectangular and planar member with fingers, notches, sockets and pins identically dimensioned to end member 90 (FIG. 10), which has finger 103 configured identically to finger 93, defining notch 101 identical to notch 91, and finger 108 configured identically to finger 98, defining notch 107 identical to notch 97. Pins 102 are similarly located and dimensioned as pins 92 and sockets 104 are similarly dimensioned and located as sockets 94, all allowing for an interlocking arrangement as that previously described. Extending from one plane of end member 100 and normal thereto are retaining means 110 and positioning plug 112. Positioning plug 112 has a square perimeter integral with second end member 100 and dimensioned to conform to the driver dimensions of a typical socket wrench thereby allowing the socket to be placed over plug 112. As shown in FIG. 11, the retaining means 110 is generally a U-shaped member with opposed vertical legs 116, and integral tab 118 of a general semicircular perimeter extending from leg 116 toward the interior of the U-shape with decreasing thickness. Removal of a socket hand tool from retention means 110 occurs by flexing the vertical legs 116 of the U-shaped member outward away from the central axis of the socket hand tool and removing it vertically upon clearance of the socket from tabs 118. To assist in flexibility of legs 116, it is preferable to place a void 114 in end member 100 configured to duplicate the plan projection of tab 118 on the plane of end member 100. Removable section 106 may be knocked out for display purposes, as well as affixing end member 100 to vertical or horizontal surfaces.

Figure 6:
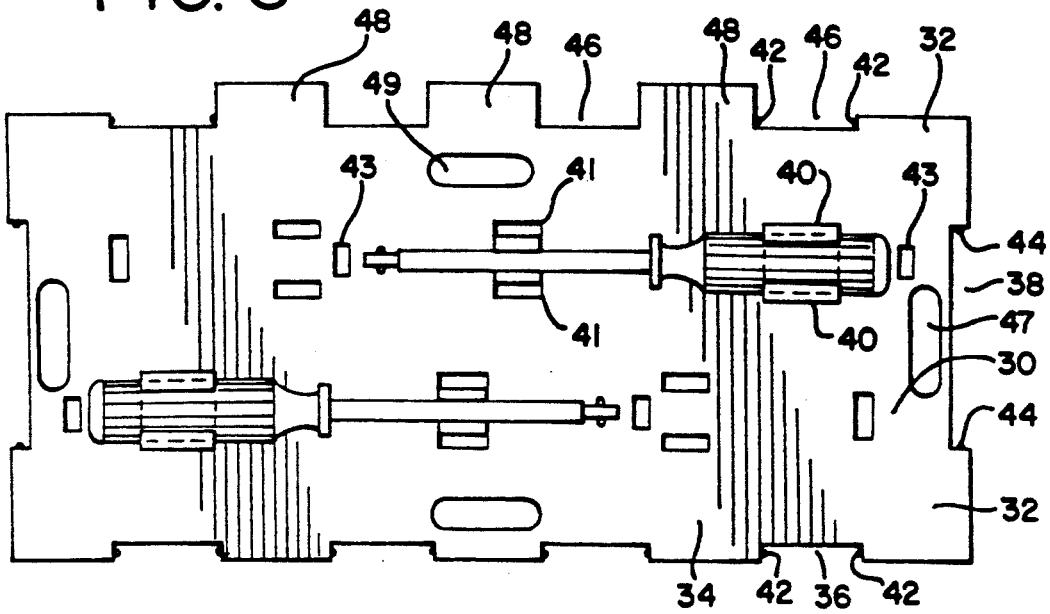
FIG. 6 is a plan view of the top member of the toolbox.

Top member 30, for retaining socket drivers, screwdrivers, and the like, as shown in FIG. 6, is a generally symmetrical, rectangular, and planar member with notches and pins identically dimensioned to base member 10 (FIG. 3). Vertex fingers 32 are configured identically to fingers 2, defining notch 38 identical to notch 8, and latitudinal fingers 34 configured identically to fingers 4, defining notches 36 identical to notches 6. Latitudinal fingers 48 extend further latitudinally than fingers 32, 34 to provide for ease of reference to a side of top member 30 when a toolbox has been formed. Notches 46, thereby formed by fingers 48, are configured identical to notches 36. Pins 42, 44 are similarly located and dimensioned as pins 12, 14, respectively, allowing for a similar interlocking arrangement as that previously described, although fewer pins are located on the side of top member 30 with fingers 48 for ease of access via top member 30 when a toolbox has been formed. Located on one plane of top member 30 are socket driver hand tool retention means 40, and positioning ribs 41, 43. Inverted L-shaped members 40 are normal to top member 30 and secured thereto at the free ends, with the members running longitudinally, and forming a cavity therebetween to receive a hand tool handle therein. Ribs 41 position driver shaft longitudinally and ribs 43 position driver longitudinally. Retention means 40, and ribs 41, 43 are preferably integral to top member 30, but may be affixed by hot melts, glue or the like. Removable sections 47, 49 are suitably located for retail display and subsequent consumer use.

Figure 2:
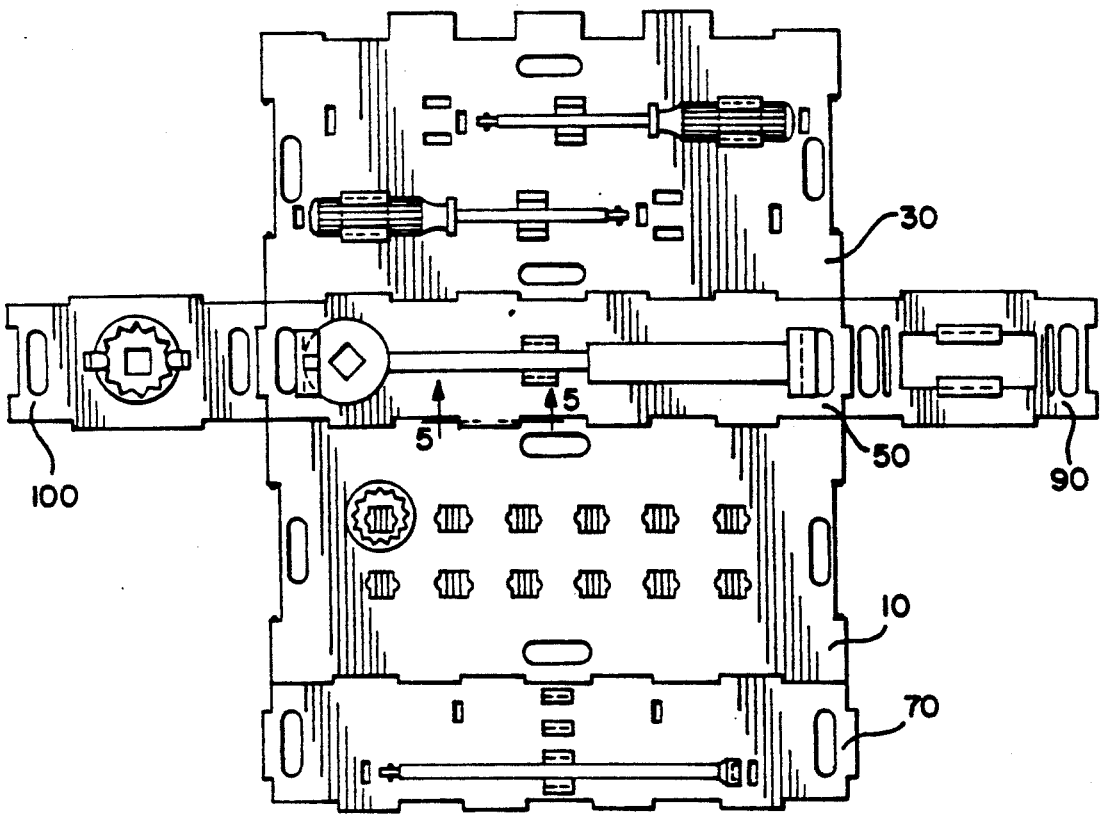
FIG. 2 is a plan view of the toolbox shown in FIG. 1, in partially constructed and flat condition.

As is readily apparent from the foregoing, arranging aforementioned members 10, 30, 50, 70, 90, and 100 as displayed in FIG. 2, will create a tool box by merely meshing respective fingers and snapping fingers into the appropriate notches. This tool box configuration allows for transport of tools and accessories to various locations, and functions as a means of organization for each tool or tool accessory that each individual generally planar member is designed to retain. Moreover, the pin and socket design and interference fit therebetween allows the tool box to be unfolded at a work location for easy access and utilization of the retained tools. In addition because of the pin and socket interference fit, each piece is potentially free to rotate 300 degrees or more in relation to an adjacent planar member. This rotational characteristic of the component members of this system allow for inverting the component members, such as essentially turning the unit inside out thereby providing access to the tools at all times during the working activity to display and provide access to tools without the inconvenience of dealing with a conventional box or toolbox lid. Additionally, the members may be interlocked in various configurations and affixed to any vertical surface to provide a display or storage utilization of the retained tools. In addition to the configuration suitable for vertical mounting depicted in FIG. 2, more stable configurations, such as an arrangement akin to a brick wall, can be readily envisioned. The modular design of the members of this system allows for a myriad of combinations to suit the environment where tools are employed.

By way of specific example as to the foregoing embodiment, the members 10, 30, 50, 70, 90, 100 are injection molded plastic, preferably polypropylene with 20% talc content, although more specialized materials such as LEXAN 10 or 11, manufactured by General Electric, also provide the required flexibility, durability, shatter resistance and temperature-resistance. The general longitudinal dimension of members 10, 30 is nine inches, of members 50, 70 nine and one-quarter inches, and of members 90, 100 four inches. The general latitudinal dimension of member 10 is four inches, of member 30 is four inches (with fingers 48 extending an additional 0.175 inches), and of members 50, 70, 90, 100 two inches. All members 10, 30, 50, 70, 90, 100 are preferably 0.1 inch thick. Base member 10 has finger 2 latitudinal side of one inch and latitudinal side of 0.980 inch. Finger 4 has a latitudinal side of 0.960 inch, thereby defining notches 6 with longitudinal dimensions of 1.04 inches. Notch 6 has a latitudinal depth and notch 8 has a longitudinal depth of 0.125 inches. Side member 50 has finger 51 latitudinal side of one inch, notch 53 latitudinal side of 0.375 inch, finger 56 and notches 52, 54 longitudinal sides of one inch. End member 90 has finger 98 longitudinal side of 2.04 inches, defining notch 97 of 0.980 inch, and finger 93 latitudinal side of 0.355 inch, defining notch 91 latitudinal side of 1.04 inch, and notch 97 latitudinal depth of 0.125 inch and notch 91 longitudinal depth of 0.125 inch.

Pins 12, 14 of base member 10 and pins 92 of end member 90 are centered on the depth dimensions of respective notches, and have hemispherical radii of 0.05 inch. Sockets 62 of side member 50 and sockets 94 of end member 90 are also centered on the depth dimension of respective notches, and have hemispherical radii of 0.05 inch. All edges of fingers on planar members 10, 30, 50, 70, 90, 100 that do not have adjoining sides with pins or sockets located thereon also have a radius of curvature that can be readily calculated by those skilled in the art to avoid interference between sides of respective fingers and notches upon rotation of interlocked members.

V-clip socket retention means 20, has a height of one-half inch from bottom member 10, with a general thickness of 0.1 inch for its members, and latitudinal dimension of 0.380 inch. Horizontal member 24 extends longitudinally 0.045 inch. Tab 22, with a radius of curvature of 0.375 inch centered on horizontal member 24, has an extension of 0.01 inch from the outer edge of horizontal member 24, thereby providing a maximum longitudinal dimension for V-clip 20 of 0.47 inch. Junction member is longitudinally dimensioned 0.38 inch. U-clip socket retention means 110, has vertical leg 116 height of 1.5625 inch from end member 100, latitudinal dimension of 0.4 inch, thickness of 0.1 inch, and legs 116 spaced apart 1.19 inch. Plug 112 is 0.375 inch square and extends 0.1 inch above the plane of end member 100. The lower plane of tabs 118 are 1.2 inch above end member 100 and have a thickness of 0.125 inch which reduces to 0.05 at the end thereof. Removable sections 16, 18, and the like are one inch long and one-quarter inch wide with an equivalent thickness to the corresponding member, but the perimeter thereof having a thickness substantially lesser than the member.

Figure 12:
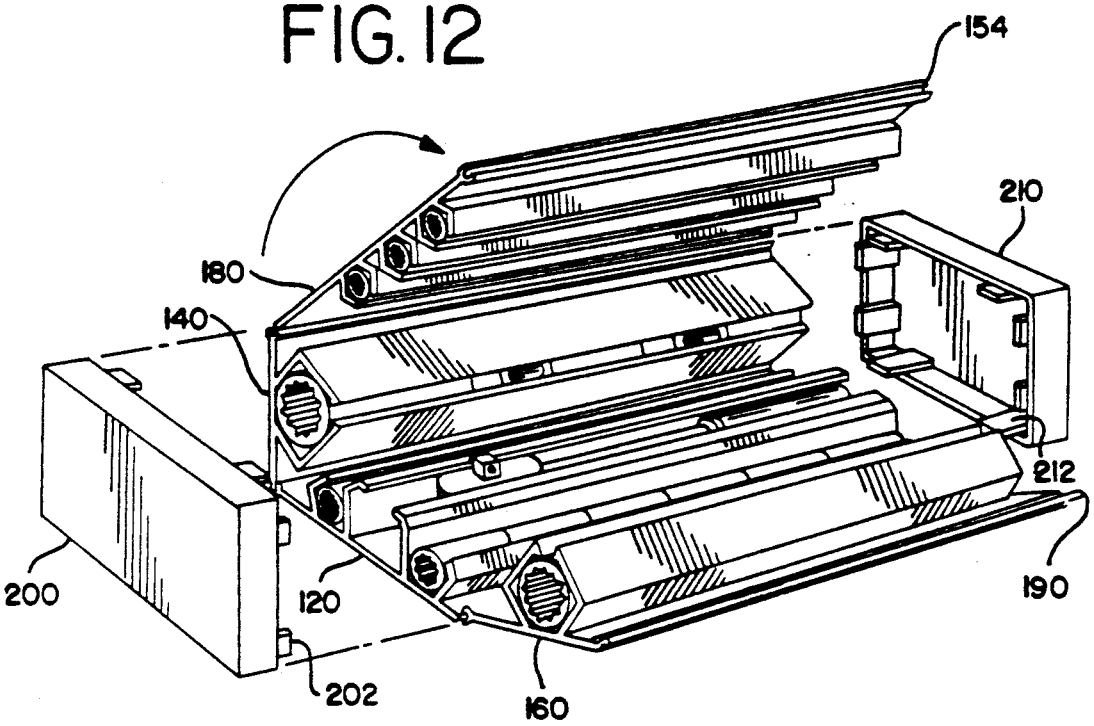
FIG. 12 is a perspective view of another article embodying the present invention, partially assembled into a right rectangular prism to provide a toolbox for organizing hand tools, such as the sockets and socket wrench shown.

An alternative embodiment of the present invention is depicted in FIG. 12. In this embodiment, generally planar and rectangular members composed of extruded plastic, preferably polyethylene, are depicted. In accordance with the alternative embodiment depicted herein, base panel 120 is interlocked with side panel 160, and side panel 140 which is in turn interlocked with top panel 180 to form a right rectangular assembly, which is secured by molded plastic end caps 200, 210 that cover either end of the assembly and secured by a plurality of tabs 202, 212 respectively.

Figure 13:
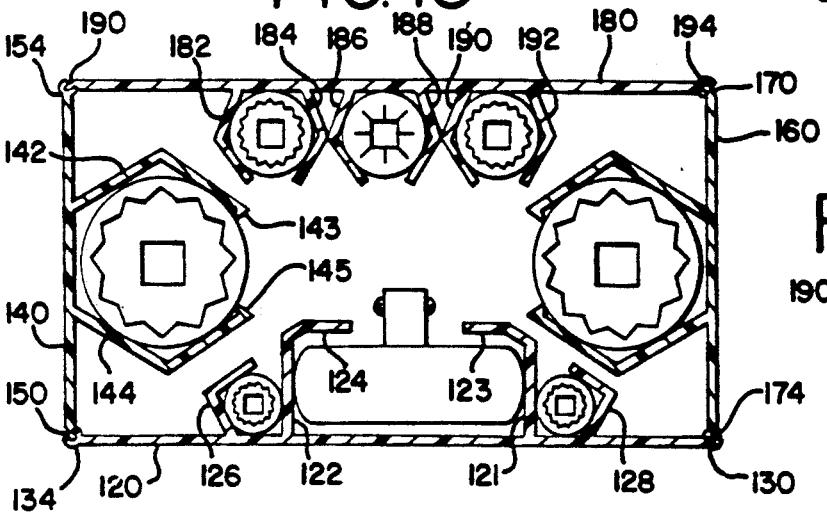
FIG. 13 is a sectional view of the fully assembled toolbox of FIG. 12, taken from an end of the toolbox after removing an end cap therefrom.
Figure 14:
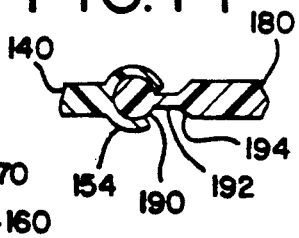
FIG. 14 is a fragmentary end view of the joint of the toolbox shown in FIG. 12, that has been placed in a flat condition.

Because the members are extruded, a cross-sectional view of the assembly as shown in FIG. 13, may best depict the respective features of each panel. Base panel 120, which is generally planar and rectangular is longitudinally symmetrical. Socket wrench retaining means, generally longitudinally-disposed and opposing inverted L-shaped members 121, 122, which are normal and integral to base panel 120, and have respective legs 123, 124 running parallel to the plane of base panel 120. L-shaped members 121, 122 are appropriately spaced to allow for sliding engagement of a typical socket wrench, depicted in FIG. 13. V-shaped members 126, 128 are positioned external to L-shaped members 122, 121 respectively, and are positioned to slidably retain typical small socket hand tools of varying internal configurations. The longitudinal sides of base panel 120 terminate on one side with a continuous groove of C-shaped cross-section 134 and on the opposite side a continuous integral cylindrical tongue 130 having a diameter matching the inside diameter of groove 134.

Side panel 140, as shown in FIG. 13, is a generally planar rectangular member with integral longitudinal V-shaped members 142, 144 oppositely opposed and opening toward each other spaced to allow for slidably retaining large socket hand tools typically found in socket wrench sets. Prong 143 integral with V-shaped member 142 as well as prong 145 integral with V-shaped member 144 are located in the interior of respective V-shaped members and provide additional contact points on the slidably engaged socket hand tool sleeve. The longitudinal sides of side panel 140 terminate at one side with a continuous cylindrical tongue 150 and at the opposite side a continuous groove of C-shaped cross-section. Side panel 160, including tongue 170 and groove 174, has identical features to that of side panel 140 for purposes of economical manufacture thereof, and therefore further discussion of this panel is unnecessary.

Top panel 180 is generally planar and rectangular with pairs of integral V-shaped members 182, 184; 186, 188; and 190, 192. Each pair of V-shaped members is oppositely opposed and appropriately spaced to provide a sliding engagement with typical diameters of socket hand tools. Top panel 180 longitudinal sides terminate on one side at continuous integral cylindrical tongue 190 and at the other side at continuous integral C-shaped cross-section groove 194.

Figure 15:
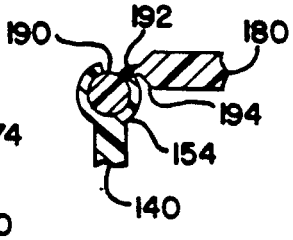
FIG. 15 is a fragmentary end view of a joint of FIG. 13, showing its deformation when the toolbox is fully assembled.

The assembly of FIG. 13 is made possible by the tongue and groove engagement of adjacent panels. As depicted in FIG. 15, a fragmentary end view of the left upper corner of assembly FIG. 13, top panel 180 and side panel 140 are interlocked by way of cylindrical cross-section tongue 190 and C-shaped cross-section groove 154. Top panel 180 is integral with tongue 190 by integral hinge 192, sometimes called by those skilled in the art a living hinge, which is continuously integral with both panel 180 and tongue 190. Those skilled in the art may properly dimension groove 154, tongue 190, hinge 192, and shoulder 194 to allow for plastic deformation of the integral hinge upon rotating panel 180 to a perpendicular orientation with respect to panel 140 when tongue 190 and groove 154 are engaged.

Figure 16:
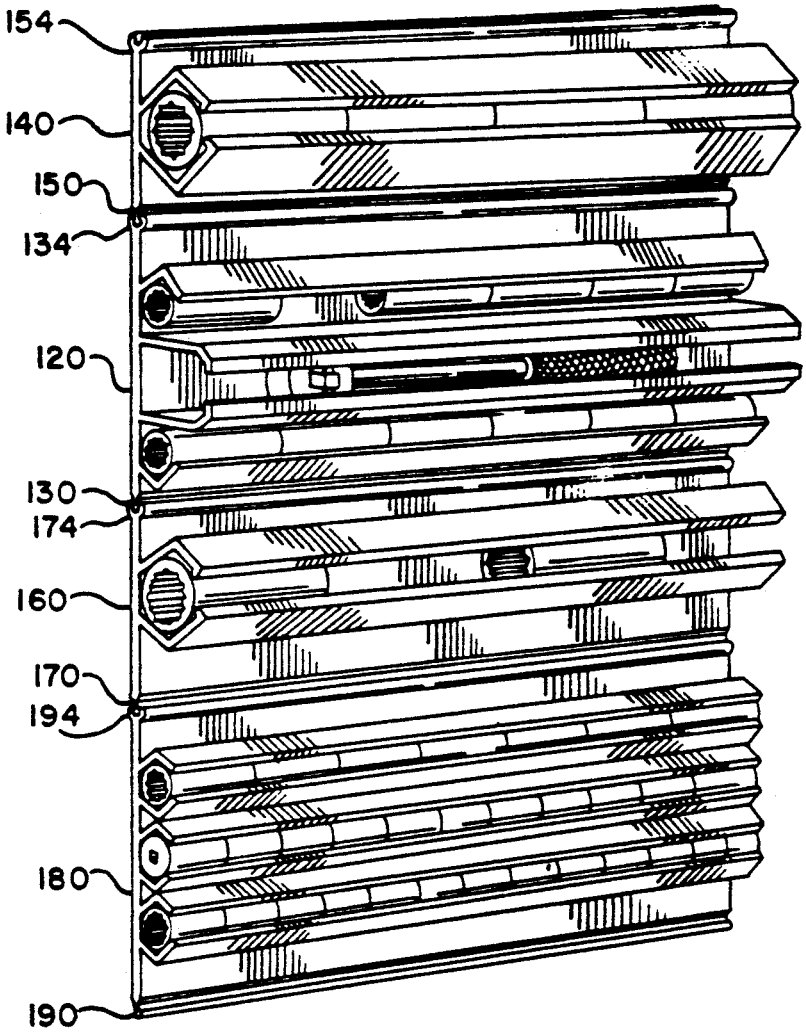
FIG. 16 is a perspective view of the toolbox shown in FIG. 12, depicting the features when in a fully flattened position.

Creation of the full assembly depicted in FIG. 13 requires assembly of the component panels thereof. Beginning, for example, with base panel 120, side panel 140 is placed on the same plane as base panel 120. Tongue 150 is introduced into groove 134 and slid along the axis defined by groove 134 until the entire length of tongue 150 is within groove 134 as shown in FIG. 16. In similar fashion, base panel 120 may be interlocked with side panel 160 via tongue 134 and groove 170. Similarly, side panel 160 may be interlocked with top panel 180 via tongue 170 and groove 194. At this point, a system for mounting tool panels has been erected which may be affixed to any vertical wall by standard fastening means such as screws or nails in the orientation displayed in FIG. 16, whereby the longitudinal axes of the hand tool retaining means are horizontally positioned.

An assembly may be created akin to a tool box in the manner shown in FIG. 12 by merely snapping tongue 190 into groove 154 to create a final interlocking engagement. At this point, all corners of the structure appear in cross-section as in FIG. 15, and the entire assembly cross-section appears as in FIG. 13. The assembly is completed by placing molded end caps 200, 210 over the assembly panel exterior, and at the ends thereof by using aligning tabs, 202, 212, which engage interior portions of the panels within the assembly.

Figure 17:
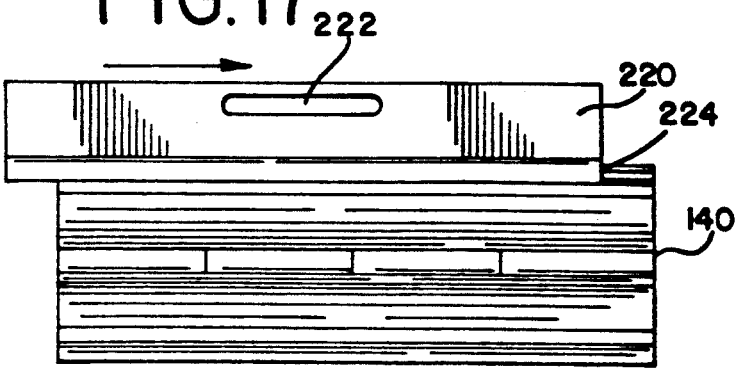
FIG. 17 is a plan view of a side panel and hanger tab slidably engaging each other.
Figure 18:
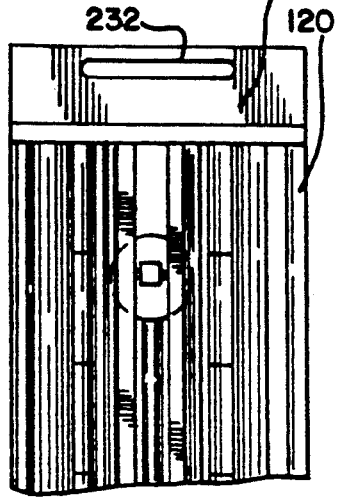
FIG. 18 is a plan view of a base panel with a molded hanger affixed thereto.

Individual panels such as side panel 140 or base panel 120, may be displayed for purchase to hardware consumers, as shown in FIG. 17, by hanger tab 220 of molded or extruded plastic, but preferably extruded polyethylene. Tab 220 is provided with tongue 224 of similar configuration to the other tongue members of the panel system. Removable section 222 may be punched out of tab 220 to provide for wire rack hangers commonly found in retail hardware establishment displays. Alternatively, and preferably in the case of expensive tools, molded hangers 230 are affixed to panels such as base panel 120, as shown in FIG. 18, by glue or hot melt glue and the like to provide a vertical orientation for the tools encased therein and thereby allow for versatile displays. Removable section 232 may be knocked out of hanger 230 for wire hangers commonly found in hardware retail displays.

The invention, as depicted by the foregoing alternative embodiments, provides a tool packaging system having several advantages over the packaging it replaces. The plastic members herein may eliminate the inefficiencies of loose tool displays and thereby preclude the indirect inventory costs passed on to consumers. Disposable packaging that is difficult or impossible to recycle may also be avoided. Moreover, inherent disadvantages of metal reusable packaging, such as rusting, painting, welding, and weight problems, as well as of blow molded plastics, such as geometry inefficiencies, lack of package durability, and ineffective tool retention may be obviated.

The depicted embodiments provide a permanent storage device for tools that ensures effective retention of tools for shipping, retail displaying, as well as storing and organizing by customers. The individual members, given their component design, may be combined to create an adaptable project support assembly that may be modified for use in horizontal, vertical, or any inclined surface, as well as into a convenient transportable solid geometry such as a toolbox, or may be expanded or collapsed into other forms suitable for specific applications.

Thus, it can be seen that the present invention provides a novel article, and while the invention has been described with reference to particular embodiments, modifications of structure, materials and the like would be apparent to those skilled in the art, yet still fall within the scope of the invention. For example, the foregoing embodiments have been described with equally thick members and uniform interlocking means. If this would not be the case, appropriate dimensioning of affected components may be made yet fall within the scope of the invention. Moreover, toolboxes of general octahedral, decahedral, etc. configurations can readily be constructed given the foregoing. Additionally, the interlocking means may be rearranged on the respective members, such as sockets located on the vertex fingers of the base members and pins on latitudinal fingers of complementary planar members in one embodiment, or grooves integral with hinges and tongues integral with corresponding panels of the other embodiment. Other interlocking means and arrangements might also be employed instead of the squared finger and notch arrangement described herein, such as triangular fingers with socket and post interlocks.

What is claimed is:

1. An article for packaging and displaying hand tools configured to mesh with a complementary article comprising:

a plastic generally planar member having fingers extending therefrom about the periphery thereof, providing notches therebetween for meshing complementary fingers therewith;

the fingers comprising collinear integral protrusions extending into the notches and parallel to the general plane of said planar member for an interference fit with complementary fingers when the fingers are meshed therewith; and plastic hand tool retaining means, located on one plane of said generally planar member, for snap fitting hand tools therein thereby securely retaining hand tools to said generally planar member.

2. The article for hand tool display and packaging of claim 1, wherein:

the fingers having a rectangular periphery and a configuration coplanar with said generally planar member; and the integral protrusions comprising pins of hemispherical configuration with radii of less than the thickness of said generally planar member.

3. The article for hand tool display and packaging of claim 1, wherein:

the hand tool retaining means comprises a V-shaped member of opposed flexible descending legs with horizontal legs and engagement tabs integral therewith at respective free ends of the descending legs for snap-fitting a socket hand tool over the V-shaped member.

4. The articles as in any of claims 1–3, further comprising:

hand tools retained within said retaining means.

5. The article for hand tool display and packaging of claim 1, wherein:

the hand tool retaining means comprises a U-shaped member of opposed flexible vertical legs with horizontal tabs integral therewith extending toward each other, and a plug integral to said generally planar member centrally located between the vertical legs for positioning a socket hand tool within the cavity defined by the U-shaped member and snap-fitting the U-shaped member about the socket hand tool.

6. The article for hand tool display and packaging of claim 1, wherein:

said generally planar member having a coplanar removable section integral therewith straddling the center of gravity of said planar member when hand tools are snap-fitted thereto.

7. The articles as in any of claims 5.6, further comprising:

hand tools retained within said retaining means.

8. An article for packaging and displaying hand tools configured to mesh with a complementary article comprising:

a plastic generally planar member having rectangular coplanar fingers extending therefrom about the periphery thereof, providing notches therebetween for meshing complementary fingers therewith;

the fingers comprising collinear integral pins extending into the notches and parallel to the general plane of said planar member for an interference fit with complementary fingers when the fingers are meshed therewith; and plastic hand tool retaining means, located on one plane of said generally planar member, for snap fitting hand tools therein thereby securely retaining hand tools to said generally planar member; and said generally planar member having a coplanar removable section integral therewith straddling the center of gravity of said planar member when hand tools are snap-fitted thereto.

9. The article for hand tool display and packaging of claim 8, wherein:

the hand tool retaining means comprises a V-shaped member of opposed flexible descending legs with horizontal legs and engagement tabs integral therewith at respective free ends of the descending legs for snap-fitting a socket hand tool over the V-shaped member.

10. The article for hand tool display and packaging of claim 8, wherein:

the hand tool retaining means comprises a U-shaped member of opposed flexible vertical legs with horizontal tabs integral therewith extending toward each other, and a plug integral to said generally planar member centrally located between the vertical legs for positioning a socket hand tool within the cavity defined by the U-shaped member and snap-fitting the U-shaped member about the socket hand tool.

11. The articles as in any of claims 8–10, further comprising:

hand tools retained within said hand tool retaining means.

12. A system for packaging, organizing or displaying hand tools comprising:

a plastic generally planar first member, having a plurality of coplanar integral fingers extending from the perimeter of said first member;

plastic hand tool retaining means, located on one plane of said first member, for snap fitting hand tools therein thereby securely retaining hand tools to said first member;

a plastic generally planar second member, having a plurality of coplanar integral fingers extending from the perimeter of said second member and complementary to the first member fingers for allowing adjacent respective fingers of said first and second members to mesh; and interlocking means, located on said first and second member fingers, for providing an interference fit between meshed fingers of said first and second members, including means for rotating said first member with respect to said second member about said interlocking means.

13. The system for packaging, organizing or displaying hand tools of claim 12, wherein:

the interlocking means comprising collinear pins on the peripheral sides of the first member fingers and collinear sockets on the peripheral sides of the second member fingers.

14. A system for packaging, displaying or storing hand tools comprising:

a plastic generally planar first member having integral coplanar fingers extending from the perimeter of said first member, defining a notch therebetween, said fingers provided with integral protrusions extending into said notch;

hand tool retaining means, located on one plane of said first planar member and integral thereto, for snap fitting hand tools therein thereby securely retaining hand tools to said first planar member;

a plastic generally planar second member having an integral coplanar finger extending from the perimeter of said second member, defining notches adjacent said finger, said second member finger provided with indentations opening into said notches;

hand tool retaining means, located on one plane of said second planar member and integral thereto, for snap fitting hand tools therein thereby securely retaining hand tools to said second planar member;

the first member fingers conforming to the notches defined by the second member finger for a meshing engagement between the first and second member fingers; and the protrusions of the first member fingers conforming to the indentations of the second member finger, and the protrusions and indentations aligned to mate collinearly upon meshing of the first and second member fingers, thereby creating an interference fit between mating protrusions and indentations and an axis of rotation thereabout.

15. A system for packaging, displaying or storing hand tools comprising:

a plastic generally planar first member having integral coplanar fingers extending from the perimeter of said first member, defining a notch therebetween, said fingers provided with indentations opening into said notch;

hand tool retaining means, located on one plane of said first planar member and integral thereto, for snap fitting hand tools therein thereby securely retaining hand tools to said first planar member;

a plastic generally planar second member having an integral coplanar finger extending from the perimeter of said second member, defining adjacent notches, said second member finger provided with protrusions extending into said notches;

hand tool retaining means, located on one plane of said second planar member and integral thereto, for snap fitting hand tools therein thereby securely retaining hand tools to said second planar member;

the first member fingers conforming to the notches defined by the second member finger thereby meshing said first and second member fingers; and the first member finger indentations conforming to the second member finger protrusions, and the protrusions and indentations aligned to mate collinearly upon meshing of said first and second member fingers, thereby creating an interference fit between mating protrusions and indentations and an axis of rotation thereabout.

16. The systems for packaging, displaying or storing hand tools as in any of claims 12–15, wherein:

the first and second member fingers having a rectangular periphery; and the protrusions comprising pins of hemispherical configuration with radii of less than the thickness of said generally planar member and integral therewith.

17. The systems for packaging, displaying or storing hand tools as in any of claims 12–15, wherein:

the hand tool retaining means comprises a V-shaped member of opposed flexible descending legs with horizontal legs and engagement tabs integral therewith at respective free ends of the descending legs for snap-fitting a socket hand tool over the V-shaped member.

18. The systems for packaging, displaying or storing hand tools as in any of claims 12–15, wherein:

the hand tool retaining means comprises a U-shaped member of opposed flexible vertical legs with horizontal tabs integral therewith extending toward each other, and a plug integral to said generally planar member centrally located between the vertical legs for positioning a socket hand tool within the cavity defined by the U-shaped member and snap-fitting the U-shaped member about the socket hand tool.

19. The systems as in any of claims 12–15, further comprising:

hand tools retained within said hand tool retaining means.

20. The systems for packaging, displaying or storing hand tools as in any of claims 12–15, wherein:

said generally planar first and second members having coplanar removable sections integral therewith straddling respective centers of gravity of said planar members when hand tools are snap-fitted thereto.

21. A plastic article for organizing sockets, socket wrenches or screwdrivers, and adapted to be formed into a box comprising:

a generally rectangular planar base member having rectangular integral coplanar fingers extending from the vertices of said base member, the base member fingers having collinear integral pins on the sides of the fingers and parallel to said base member, said base member having on one plane thereof a plurality of resilient V-shaped members secured thereto at the vertices thereof, said V-shaped members with oppositely opposed curved wing portions on the free ends thereof for snap fitting a socket hand tool thereto;

a generally rectangular planar first side member, longitudinally defined by the longitudinal edge of said base member, having rectangular integral coplanar fingers extending from the perimeter thereof and complementary to the latitudinal fingers of said base member, the side member fingers having on the sides thereof collinear sockets parallel to said first side member, the latitudinal fingers of said first side member meshing with respective latitudinal fingers of said base member and the respective pins and sockets thereof interlocking thereby creating an axis of rotation thereabout, said first side member having on one plane thereof a plurality of resilient inverted L-shaped members secured at the free ends of the L-shapes and normal to said side member, said L-shaped members paired and opposed for snap fitting a socket extension hand tool shaft therein;

a generally rectangular planar second side member having a perimeter substantially identical to said first side member, the second side member latitudinal fingers meshing with respective latitudinal fingers of said base member and the respective pins and sockets thereof interlocking thereby creating an axis of rotation thereabout, said second side member having on one plane thereof a plurality of resilient inverted generally L-shaped members secured at the free ends of the general L-shapes and normal to said side member, with one pair of L-shaped members opposed and longitudinally disposed to snap fit therein a socket wrench head and handle and a second pair of L-shaped members opposed and latitudinally disposed to snap fit therein a wrench hand tool shaft;

a generally rectangular planar first end member, latitudinally defined by the latitudinal edge of said second side member and longitudinally defined by the latitudinal edge of said base member, having rectangular integral coplanar latitudinal fingers complementary to the longitudinal base member fingers and rectangular integral coplanar longitudinal fingers complementary to the longitudinal second side member fingers, the latitudinal fingers having on the sides thereof collinear sockets parallel to said first end member, the fingers meshing with respective longitudinal base member fingers and the respective pins and sockets interlocking thereby creating an axis of rotation thereabout, the longitudinal fingers having on the sides thereof collinear pins parallel to said first end member, the fingers meshing with respective longitudinal second side member fingers and the respective pins and sockets interlocking with respective sockets thereby orthoganally relating said first end member, said base member and said second side member, said first end member having on one plane thereof a plurality of opposed resilient inverted generally L-shaped members for snap fitting a socket hand tool sleeve;

a generally rectangular planar second end member having a perimeter substantially identical to said first end member, the second end member latitudinal fingers meshing with respective longitudinal fingers of said base member and the respective pins and sockets interlocking thereby creating an axis of rotation thereabout, the longitudinal fingers disposed on one of the sides of said second end member meshing with respective longitudinal fingers of said first side member and the respective pins and sockets interlocking thereby orthoganally relating said second end member, said first side member, and said base member, the longitudinal fingers disposed on the other side of said second end member meshing with respective longitudinal fingers of said second side member and the respective pins and sockets interlocking thereby forming a toolbox, said second end member having on one plane thereof and normal thereto a plurality of opposed resilient generally r-shaped members secured at the base of the general r-shape to said second end member, and a reference plug integral to said second end member and centered between the r-shaped members, the r-shaped members spaced for snap fitting therebetween and under respective arms a socket hand tool axially oriented parallel to the lengths of the r-shaped members;

a generally rectangular planar top member having a perimeter substantially identical to said base member, with at least one of the latitudinal fingers of said top member extending further latitudinally than other fingers thereof, the latitudinal fingers thereof meshing with respective latitudinal fingers of said second side member and the respective pins and sockets thereof interlocking thereby creating an axis of rotation thereabout and a lid to the toolbox, said top member having on one plane thereof and secured normal thereto a plurality of generally inverted L-shaped members opposed for snap fitting a longitudinally oriented screwdriver hand tool handle therein.

22. The plastic article for organizing sockets, socket wrenches or screwdrivers, and adapted to be formed into a box of claim 21, wherein:

the base member, first side member, second side member, first end member, second end member, and top member each having a coplanar removable section integral therewith.

23. The articles for organizing sockets, socket wrenches or screwdrivers, as in any of claims 21–22, further comprising:

hand tool retained within said hand tool retaining means.

24. A plastic article for packaging or displaying hand tools comprising:

a generally planar rectangular panel having an integral continuous groove along one side of said panel;

hand tool retaining means comprising a plurality of opposed continuous retaining members, each member integral with said panel and on one plane thereof and parallel to the continuous groove defined therein, for slidably engaging hand tools therein; and said panel having an integral hinge along a side of said panel oppositely disposed from the groove, the free end of the integral hinge having a continuous tongue thereon for engaging the groove.

25. A plastic article for packaging or displaying hand tools comprising:

a generally planar rectangular panel having an integral continuous tongue along one side of said panel;

hand tool retaining means comprising a plurality of opposed continuous retaining members, each member integral with said panel and on one plane thereof and parallel to the continuous tongue defined thereon, for slidably engaging hand tools therein; and said panel having an integral hinge along a side of said panel oppositely disposed from the tongue, the free end of the integral hinge having a continuous groove therein for engaging the tongue.

26. The plastic articles as in any of claims 24, 25, wherein:

the groove defined to snap fit and slidably engage the tongue; and the hand tool retaining means comprising a plurality of opposed continuous V-shaped members, each member integral to said panel at one end thereof, receiving longitudinally oriented hand tools.

27. The plastic articles as in any of claims 24, 25, further comprising:

a plastic tab member, having removable section defined therein, slidably engaged with one of the tongue and groove of said panel.

28. The plastic articles as in any of claims 24, 25, further comprising:

a plastic tab member, having removable section defined therein, molded to said panel at a side thereof not having the groove therein or tongue thereon.

29. The plastic articles as in any of claims 24, 25, further comprising:

hand tools retained with said hand tool retaining means.

30. A plastic article adapted to be erected to form a box for organizing or packaging hand tools such as sockets, socket wrenches, or screwdrivers comprising:

a generally planar rectangular first member divided by at least one continuous integral longitudinal hinge, defining at least one panel thereof, said first member having a longitudinal tongue formed on one longitudinal side thereof, said tongue connected to the panel of said member by the continuous integral longitudinal hinge, said first member having a longitudinal groove formed in one longitudinal side thereof, oppositely disposed from said tongue, said groove having an interior perimeter configured to slidably engage said tongue, a plurality of opposed continuous longitudinal V-shaped members, each member integral to the first member panel at one free end thereof, said opposed members adapted to receive axially a longitudinally oriented socket hand tool;

a generally planar rectangular second member divided by at least one continuous integral longitudinal hinge, defining at least one panel thereof, said second member having a longitudinal tongue formed on one longitudinal side thereof, said tongue connected to the panel of said member by the continuous integral longitudinal hinge, said second member having a longitudinal groove formed in one longitudinal side thereof, oppositely disposed from said tongue, said groove having an interior perimeter configured to slidably engage said tongue, a plurality of opposed continuous longitudinal V-shaped members, each member integral to the second member panel at one free end thereof, said opposed members adapted to receive axially a longitudinally oriented screwdriver;

a generally planar rectangular third member divided by at least one continuous integral longitudinal hinge, defining at least one panel thereof, said third member having a longitudinal tongue formed on one longitudinal side thereof, said tongue connected to the panel of said member by the continuous integral longitudinal hinge, said third member having a longitudinal groove formed in one longitudinal side thereof, oppositely disposed from said tongue, said groove having an interior perimeter configured to slidably engage said tongue, a plurality of opposed continuous longitudinal L-shaped members, each member integral to the third member panel at one free end thereof, said opposed members adapted to receive axially a longitudinally oriented socket wrench;

a generally planar rectangular fourth member divided by at least one continuous integral longitudinal hinge, defining at least one panel thereof, said fourth member having a longitudinal tongue formed on one longitudinal side thereof, said tongue connected to the panel of said member by the continuous integral longitudinal hinge, said fourth member having a longitudinal groove formed in one longitudinal side thereof, oppositely disposed from said tongue, said groove having an interior perimeter configured to slidably engage said tongue, a plurality of opposed continuous longitudinal V-shaped members, each member integral to the fourth member panel at one free end thereof, said opposed members adapted to receive axially a longitudinally oriented socket hand tool;

said first member tongue slidably engaged within said second member groove, said second member tongue slidably engaged within said within said third member groove, said third member tongue slidable engaged within said fourth member groove, said fourth member tongue snap fitted within said first member groove thereby forming a rectangular assembly; and end cap means for engaging the ends of said assembly.

* * * * *

UNITED STATES PATENT AND TRADEMARK OFFICE

CERTIFICATE OF CORRECTION

PATENT NO. : 5,217,115

DATED : June 8, 1993

INVENTOR(S) : Emerson Purkapile

It is certified that error appears in the above-indentified patent and that said Letters Patent is hereby corrected as shown below:

IN THE CLAIMS

Column 13, claim 7, line 1, delete "5.6." and substitute therefor --5-6--.

Col. 18, claim 23, line 4, delete "tool" and substitute therefor --tools--.

Col. 20, claim 30, line 28, delete "within said".

Col. 20, claim 30, line 30, delete "slidable" and substitute therefor --slidably--.

Signed and Sealed this

Twenty-sixth Day of July, 1994

*Attest:*

*Attesting Officer*

BRUCE LEHMAN

*Commissioner of Patents and Trademarks*